US005494019A

United States Patent [19]

Ogawa

[11] Patent Number: 5,494,019

[45] Date of Patent: Feb. 27, 1996

[54] CONTROL SYSTEM FOR INTERNAL COMBUSTION ENGINES

[75] Inventor: Ken Ogawa, Wako, Japan

[73] Assignee: Honda Giken Kogyo K.K. (Honda Motor Co., Ltd. in English), Tokyo, Japan

[21] Appl. No.: 370,177

[22] Filed: Jan. 9, 1995

[30] Foreign Application Priority Data

Jan. 12, 1994 [JP] Japan ..... 6-013999

[51] Int. Cl.[6] ..... F02D 41/04; F02D 41/34

[52] U.S. Cl. ..... 123/480; 123/492

[58] Field of Search ..... 123/478, 480, 123/491, 492, 493

[56] References Cited

U.S. PATENT DOCUMENTS

| | | | |
|---|---|---|---|
| 4,705,004 | 11/1987 | Takahashi et al. | 123/491 |
| 4,922,877 | 5/1990 | Nagaishi | 123/493 X |
| 5,320,079 | 6/1994 | Kuwabara | 123/491 |
| 5,426,938 | 6/1995 | Ogawa et al. | 123/480 X |

FOREIGN PATENT DOCUMENTS 61-126337 6/1986 Japan .

*Primary Examiner*—Tony M. Argenbright
*Attorney, Agent, or Firm*—Arthur L. Lessler

[57] ABSTRACT

A control system for an internal combustion engine calculates an amount of fuel to be supplied to the engine based on load on the engine, and estimates an amount of fuel adhering to an inner wall surface of an intake passage of the engine and an amount of fuel carried off the fuel adhering to the inner wall surface of the intake passage, based on an adherent fuel-determining parameter indicative of a fuel transfer characteristic of the engine. The amount of fuel to be supplied to the engine is corrected based on the amount of fuel adhering to the inner wall surface of the intake passage and the amount of fuel carried off the fuel adhering to the inner wall surface of the intake passage to determine a corrected amount of fuel supplied to the engine. The corrected amount of fuel to be supplied to the engine is injected into the intake passage. The timing of the fuel injection is controlled based on the adherent fuel-determining parameters.

6 Claims, 10 Drawing Sheets

INTERNAL COMBUSTION ENGINE
INPUT CIRCUIT
C P U
MEMORY MEANS
OUTPUT CIRCUIT
ECU
FUEL INJECTION VALVE
ELECTROMAGNETIC VALVE
POIL
TC
LAF
CYL
CRK
TW
IG
TA
PBA
θ TH

CYL SIGNAL PULSE
TDC-DISCRIMINATING SIGNAL PULSE
CRK SIGNAL PULSE (#1CYL STAGE NO.)
SINJ(K)
FUEL INJECTION VALVE
CLOSED
OPEN
90°
180°
30°
CRME
#7
#8
#9
#10
#11
#12
#13
#14
#15
#16
#17
#18
#19
#20
#21
#22
#23
#0
#1
#2
#3
0
1
2
3
0
#1 EXHAUST STROKE
#1 INTAKE STROKE
#1 COMPRESSION STROKE
#1 EXPLOSION STROKE
C1

FIG.5

$\theta_{INJ}$ DETERMINATION

- DETERMINE $\theta_{INJA}$ BY $\theta_{INJ}$ MAP(S41)
- DETERMINE A,B BY A/B TABLE (S42)
- LIMIT-CHECK $\theta_{INJA}$ (S43)
- DETERMINE $\theta_{INJA}$,A,B (S44)
- →RETURN

FIG.6

| | TW0 | ⋯ | TW6 |
|---|---|---|---|
| PBA0 | $\theta_{INJA}(0,0)$ | ⋯ | $\theta_{INJA}(0,6)$ |
| ⋮ | ⋮ | ⋱ | ⋮ |
| PBA6 | $\theta_{INJA}(6,0)$ | ⋯ | $\theta_{INJA}(6,6)$ |

FIG.11

| | KEGR0 | ..... | KEGR4 |
|---|---|---|---|
| PBA0 | KEA(0,0) | ..... | KEA(0,4) |
| ⋮ | ⋮ | ⋱ | ⋮ |
| PBA6 | KEA(6,0) | ..... | KEA(6,4) |

FIG.12

| | KEGR0 | ..... | KEGR4 |
|---|---|---|---|
| PBA0 | KEB(0,0) | ..... | KEB(0,4) |
| ⋮ | ⋮ | ⋱ | ⋮ |
| PBA6 | KEB(6,0) | ..... | KEB(6,4) |

TWP DETERMINATION

CONTROL SYSTEM FOR INTERNAL COMBUSTION ENGINES

BACKGROUND OF THE INVENTION

1. Field of the Invention

This invention relates to a control system for internal combustion engines, and more particularly to an control system for an internal combustion engine adapted to perform control of a fuel injection amount while taking into account an amount of fuel (liquid fuel) adhering to the inner wall surface of the intake pipe of the engine after being injected into the intake pipe.

2. Prior Art

In an internal combustion engine wherein liquid fuel such as gasoline is injected into the intake pipe of the engine, part of the injected fuel adheres to the inner wall surface of the intake pipe so that unfavorably a required amount of fuel is not supplied to the combustion chamber of the engine. A fuel supply amount control method for internal combustion engines, which eliminates the above inconvenience, has been known, for example, from Japanese Provisional Patent Publication (Kokai) No. 61-126337, which estimates an amount of fuel (adherent fuel amount) adhering to the inner wall surface of the intake pipe and a fuel amount carried off (drawn) from the inner surface of the intake pipe into the combustion chamber of the engine due to evaporation of adherent fuel or a drawing force of intake air, to determine the fuel injection amount for the engine by taking into account these estimations. That is, the method corrects an amount of fuel to be injected into the engine determined based on operating conditions of the engine, according to these estimated values of the adherent fuel amount and the carried-off fuel amount.

However, in the conventional method of the adherent fuel-dependent correction does not contemplate the fuel injection timing, which can result in an excessive correction of the fuel injection amount and hence failure to achieve satisfactorily excellent fuel consumption and exhaust emission characteristics. Especially, in a transient operating condition of the engine, the method fails to effect proper correction of the fuel injection amount to make the air-fuel ratio of a mixture supplied to the engine difficult to be converged, which results in degraded drivability.

SUMMARY OF THE INVENTION

It is an object of the invention to provide an control system for internal combustion engines, which is capable of performing the optimum correction of the fuel injection amount based on an estimated amount of fuel adhering to the wall surface of the intake pipe, by taking the fuel injection timing into account, to thereby improve the fuel consumption, drivability and exhaust emission characteristics of the engine.

To attain the above objects, the present invention provide a control system for an internal combustion engine having an intake passage, and at least one combustion chamber, the intake passage having an inner wall surface, the control system including:

fuel supply amount-calculating means for calculating an amount of fuel to be supplied to the engine, based on load on the engine;

adherent fuel amount/carried-off fuel amount-estimating means for estimating an amount of fuel adhering to the inner wall surface of the intake passage and an amount of fuel carried off the fuel adhering to the inner wall surface of the intake passage and drawn into the combustion chamber of the engine, based on adherent fuel-determining parameters indicative of fuel transfer characteristics of the engine;

fuel supply amount-correcting means for correcting the amount of fuel calculated by the fuel supply amount-calculating means, based on the amount of fuel adhering to the inner wall surface of the intake passage and the amount of fuel carried off the fuel adhering to the inner wall surface of the intake passage, to determine a corrected amount of fuel to be supplied to the engine; and fuel injection means for injecting the corrected amount of fuel to be supplied to the engine obtained by the fuel supply amount-correcting means into the intake passage.

The control system according to the invention is characterized by comprising:

fuel injection timing control means for controlling timing of the fuel injection by the fuel injection means, based on the adherent fuel-determining parameters.

Preferably, the adherent fuel-determining parameters include a direct supply ratio (A) defined as a ratio of an amount of fuel injected and directly drawn into the combustion chamber during a present operating cycle of the engine to the whole amount of fuel injected during the present operating cycle, and a carry-off ratio (B) defined as a ratio of an amount of fuel carried off the fuel adhering to the inner wall surface of the intake passage and drawn into the combustion chamber during the present operating cycle, to the amount of fuel adhering to the inner wall surface of the intake passage up to an immediately operating cycle of the engine, and the adherent fuel amount/carried-off fuel amount-estimating means comprising:

adherent fuel amount-estimating means for estimating the adherent fuel amount, based on the direct supply ratio (A) and the carry-off ratio (B); and carried-off fuel amount-estimating means for estimating the carried-off fuel amount, based on the direct supply ratio (A) and the carry-off ratio (B); and the fuel injection timing control means controlling the timing of fuel injection by the fuel injection means such that the direct supply ratio (A) becomes the maximum.

Alternatively, the fuel injection timing control means controlling the timing of fuel injection by the fuel injection means such that (1-B)/A becomes the minimum.

More preferably, the timing of fuel injection is a time point of termination of fuel injection.

The above and other objects, features and advantages of the invention will become more apparent from the following detailed description taken in conjunction with the accompanying drawings.

BRIEF DESCRIPTION OF THE DRAWINGS

FIG. 5 is a flowchart showing a program for determining fuel injection timing;

FIG. 6 shows a θINJ map;

FIG. 11 shows a KEA map;

FIG. 12 shows a KEB map; and

DETAILED DESCRIPTION

The invention will now be described in detail with reference to the drawings showing an embodiment thereof.

Figure 1:
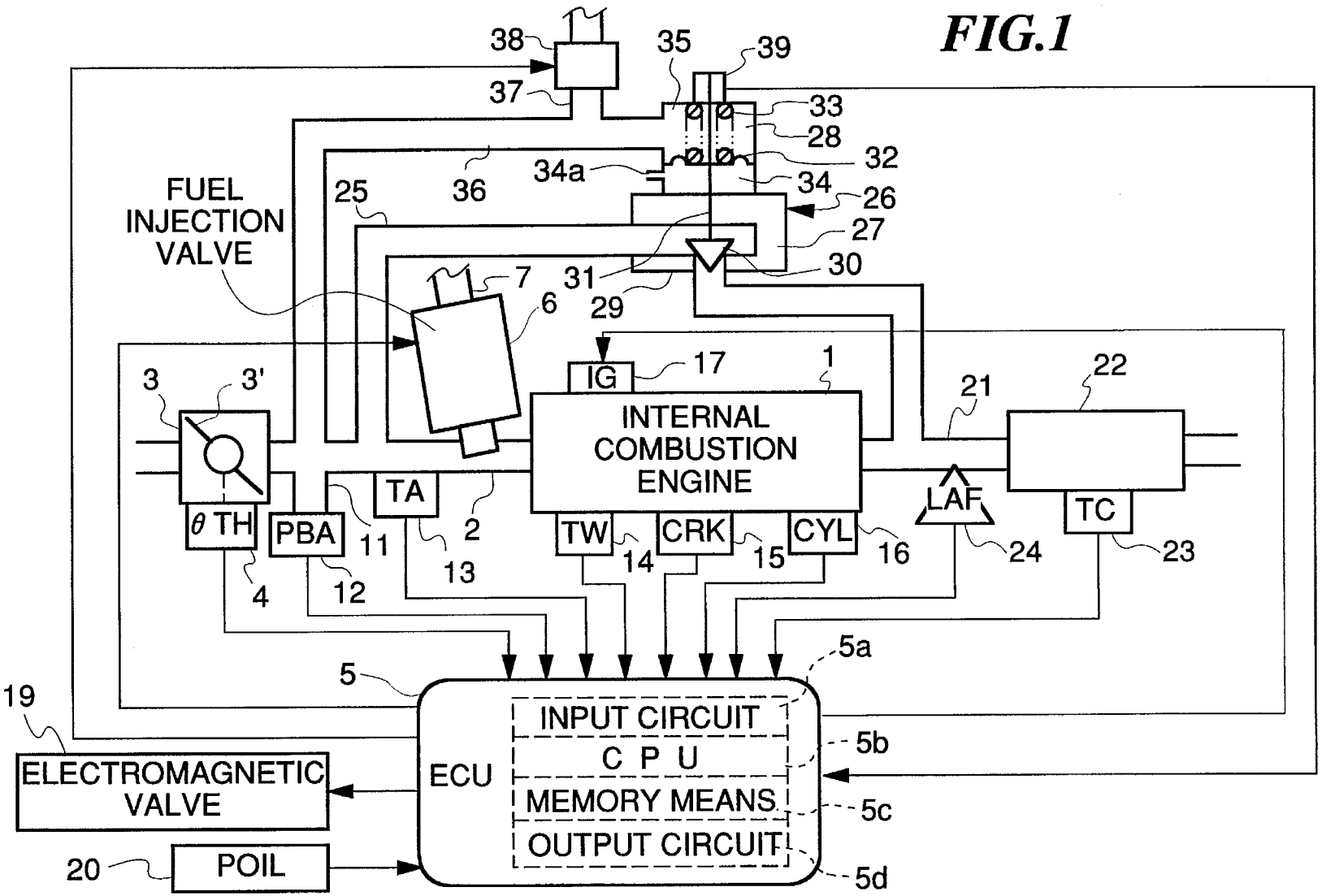
FIG. 1 is a block diagram schematically showing the whole arrangement of an internal combustion engine and an control system therefor, according to an embodiment of the invention.

Referring first to FIG. 1, there is illustrated the whole arrangement of an internal combustion engine and a control system therefor, according to an embodiment of the invention.

In the figure, reference numeral 1 designates a DOHC straight type four-cylinder engine (hereinafter simply referred to as "the engine"), each cylinder being provided with a pair of intake valves, not shown, and a pair of exhaust valves, not shown. This engine is constructed such that it is capable of changing operating characteristics of the intake valves and exhaust valves, for example, the valve opening period and the valve lift (generically referred to hereinafter as "the valve timing") between a high speed valve timing (hereinafter referred to as "the high speed V/T") adapted for engine operation in a high engine speed region and a low speed valve timing (hereinafter referred to as "the low speed V/T") adapted for engine operation in a low engine speed region.

Connected to an intake port, not shown, of the cylinder block of the engine 1 is an intake pipe 2 across which is arranged a throttle body 3 accommodating a throttle valve 3' therein. A throttle valve opening (θTH) sensor 4 is connected to the throttle valve 3' for generating an electric signal indicative of the sensed throttle valve opening θTH and supplying same to an electric control unit (hereinafter referred to as "the ECU") 5.

Fuel injection valves 6, only one of which is shown, are inserted into the intake pipe 2 at locations intermediate between the cylinder block of the engine 1 and the throttle valve 3' and slightly upstream of respective intake valves, not shown. The fuel injection valves 6 are connected to a fuel pump, not shown, via a fuel supply pipe 7 and electrically connected to the ECU 5 to have their valve opening periods controlled by signals therefrom.

Further, an intake pipe absolute pressure (PBA) sensor 12 is provided in communication with the interior of the intake pipe 2 via a conduit 11 opening into the intake pipe 2 at a location between the throttle valve 3' and the fuel injection valves 6, for supplying an electric signal indicative of the sensed absolute pressure PBA within the intake pipe 2 to the ECU 5.

An intake air temperature (TA) sensor 13 is inserted into the intake pipe 2 at a location downstream of the conduit 11, for supplying an electric signal indicative of the sensed intake air temperature TA to the ECU 5.

An engine coolant temperature (TW) sensor 14 formed of a thermistor or the like is inserted into a coolant passage filled with a coolant and formed in the cylinder block, for supplying an electric signal indicative of the sensed engine coolant temperature TW to the ECU 5.

A crank angle (CRK) sensor 15 and a cylinder-discriminating (CYL) sensor 16 are arranged in facing relation to a camshaft or a crankshaft of the engine 1, neither of which is shown.

The CRK sensor 15 generates a CRK signal pulse whenever the crankshaft rotates through a predetermined angle (e.g. 30 degrees) smaller than half a rotation (180 degrees) of the crankshaft of the engine 1, while the CYL sensor 16 generates a pulse (hereinafter referred to as "the CYL signal pulse") at a predetermined crank angle of a particular cylinder of the engine, both of the CRK signal pulse and the CYL signal pulse being supplied to the ECU 5.

Each cylinder of the engine has a spark plug 17 electrically connected to the ECU 5 to have its ignition timing controlled by a control signal supplied therefrom.

Further connected to an output circuit 5*d* of the ECU 5 is an electromagnetic valve 19 for making changeover of the valve timing, which has opening and closing operations thereof controlled by a signal from the ECU 5. The electromagnetic valve 19 selects either high or low hydraulic pressure applied to a valve timing changeover device, not shown. Responsive to this high or low hydraulic pressure selected, the valve timing changeover device operates to change the valve timing to either the high speed V/T or the low speed V/T. The hydraulic pressure applied to the valve timing changeover device is detected by a hydraulic pressure (oil pressure) (Poil) sensor 20 which supplies an electric signal indicative of the sensed hydraulic pressure POIL to the ECU 5.

A catalytic converter (three-way catalyst) 22 is arranged in an exhaust pipe 21 connected to an exhaust port, not shown, of the engine 1, for purifying noxious components, such as HC, CO, NOx, which are present in exhaust gases.

A catalyst temperature (TC) sensor 23, which is formed of a thermistor or the like, is inserted into a housing wall of the catalytic converter 22, for supplying an electric signal indicative of the sensed temperature TC of the catalytic converter 22 to the ECU 5.

A linear output type air-fuel ratio sensor (hereinafter referred to as "the LAF sensor") 24 is arranged in the exhaust pipe 21 at a location upstream of the catalytic converter 22. The LAF sensor 24 supplies an electric signal which is substantially proportional to the concentration of oxygen present in exhaust gases to the ECU 5.

An exhaust gas recirculation passage 25 is arranged between the intake pipe 2 and the exhaust pipe 21 such that it bypasses the engine 1. The exhaust gas recirculation passage 25 has one end thereof connected to the exhaust pipe 21 at a location upstream of the LAF sensor 24 (i.e. on the engine side of same), and the other end thereof connected to the intake pipe 2 at a location downstream of the PBA sensor 12.

An exhaust gas circulation control valve (hereinafter referred to as "the EGR control valve") 26 is arranged in an intermediate portion of the exhaust gas recirculation passage 25. The EGR valve 26 is comprised of a casing 29 defining a valve chamber 27 and a diaphragm chamber 28 therein, a valving element 30 in the form of a wedge arranged in the valve chamber 27, which is vertically movable so as to open and close the exhaust gas recirculation passage 25, a diaphragm 32 connected to the valving element 30 via a valve stem 31, and a spring 33 urging the diaphragm 32 in a valve-closing direction. The diaphragm chamber 32 is divided by the diaphragm 32 into an atmospheric pressure chamber 34 on the valve stem side and a negative pressure chamber 35 on the spring side.

The atmospheric pressure chamber 34 is communicated to the atmosphere via an air inlet port 34*a*, while the negative pressure chamber 35 is connected to one end of a negative pressure-introducing passage 36. The negative pressure-introducing passage 36 has the other end thereof connected to the intake pipe 2, for introducing the absolute pressure PBA (negative pressure) into the negative pressure chamber 35. The negative pressure-introducing passage 36 has an air-introducing passage 37 connected to an intermediate portion thereof, and the air-introducing passage 37 has a pressure control valve 38 arranged in an intermediate portion thereof. The pressure control valve 38 is an electromagnetic valve of a normally-closed type, and negative pressure prevailing within the negative pressure-introducing passage 36 is controlled by the pressure control valve 38, whereby a predetermined level of negative pressure is created within the negative pressure chamber 35.

A valve opening (lift) sensor (hereinafter referred to as "the L sensor for EGR") 39 is provided for the EGR valve 26, which detects an operating position (lift amount) of the valving element 30 thereof, and supplies a signal indicative of the sensed lift amount to the ECU 5. In addition, the EGR control is performed after the engine has been warmed up (e.g. when the engine coolant temperature TW is equal to or higher than a predetermined value).

The ECU 5 is comprised of an input circuit 5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as the "the CPU") 5*b*, memory means 5*c* formed of a ROM (read only memory) storing various operational programs which are executed by the CPU 5*b*, and various maps and tables, referred to hereinafter, and a RAM (random access memory) for storing results of calculations therefrom, etc., the aforementioned output circuit 5*d* which outputs driving signals to the fuel injection valves 6, the spark plugs 17, the electromagnetic valve 19, etc.

Figure 2:
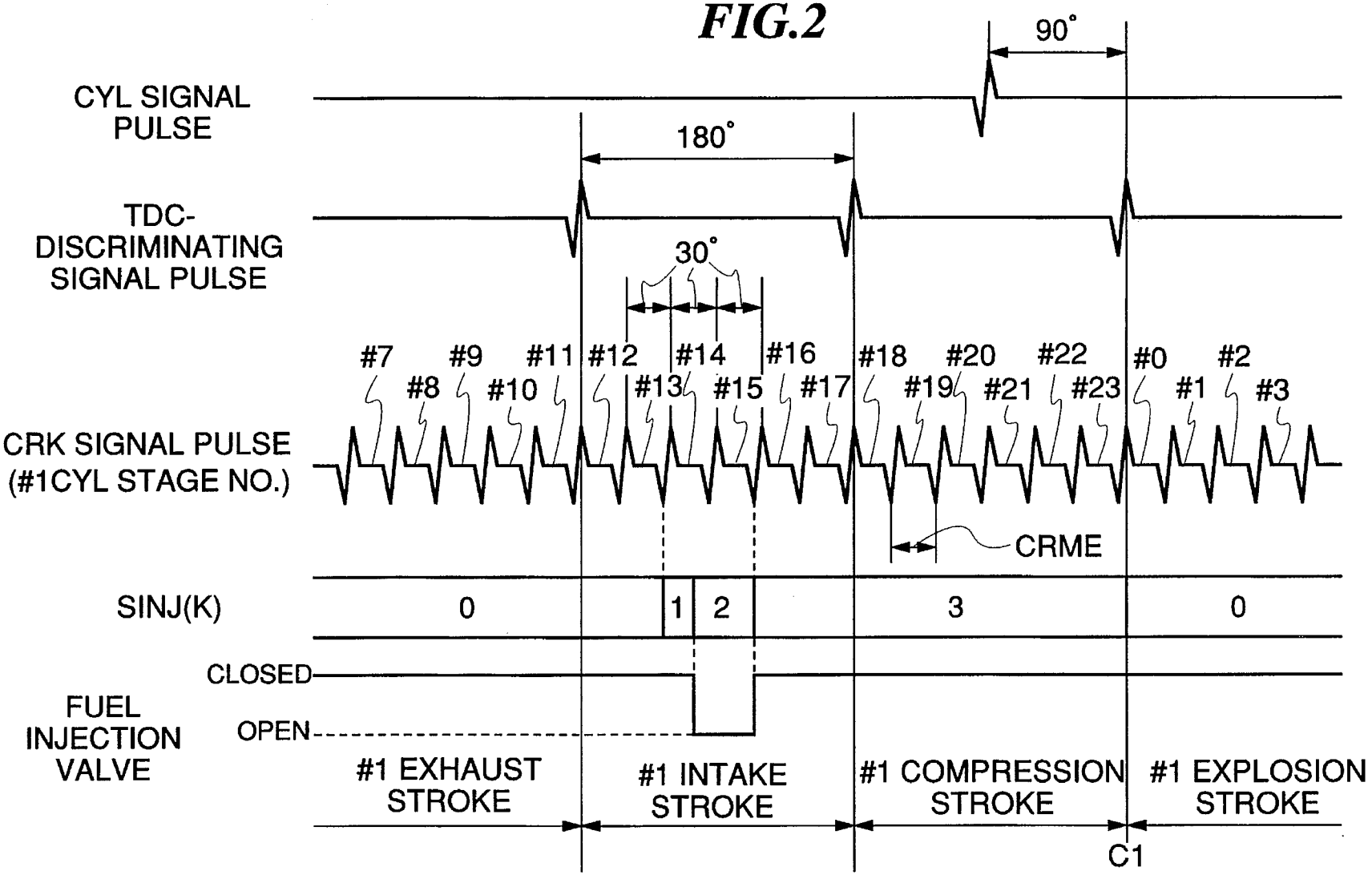
FIG. 2 is a timing chart showing a CYL signal pulse, TDC-discriminating signal pulses, CRK signal pulses, a status number SINJ(k) and the operative state of a fuel injection valve.

FIG. 2 shows a timing chart showing the relationship in timing between CRK signal pulses from the CRK sensor 12, CYL signal pulses from the CYL sensor 13, TDC-discriminating signal pulses from the ECU 5, and timing of injection fuel by the fuel injection valves 6.

Twenty-four CRK signal pulses are generated per two rotations of the crankshaft at regular intervals with respect to the top dead center position of each of the four cylinders (#1 to #4 CYL), i.e. one CRK signal pulse whenever the crankshaft rotates through 30 degrees. The ECU 5 generates a TDC-discriminating signal pulse in synchronism with a CRK signal pulse generated at the top dead center position of each cylinder. The TDC-discriminating signal pulses indicate reference crank angle positions of the respective cylinders and are each generated whenever the crankshaft rotates through 180 degrees.

The ECU 5 measures time intervals of generation of the CRK signal pulses to calculate CRME values, which are added together over a time period of generation of two TDC-discriminating signal pulses i.e. over a time period of one rotation of the crankshaft to calculate an ME value, and then calculates the engine rotational speed NE, which is the reciprocal of the ME value, based on the ME value.

CYL signal pulses are each generated as briefly described above, at a predetermined crank angle position of a particular cylinder (cylinder #1 in the illustrated example), e.g. when the #1 cylinder is in a position 90 degrees before a TDC position thereof corresponding to the end of the compression stroke of the cylinder, to thereby allot a particular cylinder number (e.g. #1 CYL) to a TDC-discriminating signal pulse generated immediately after a CYL signal pulse is generated.

The ECU 5 detects crank angle stages (hereinafter referred to as "the stages") in relation to the reference crank angle position of each cylinder, based on the TDC-discriminating signal pulses and the CRK signal pulses. More specifically, the ECU 5 determines, for instance, that the #1 cylinder is in a #0 stage when a CRK signal pulse is generated, which corresponds to a TDC-discriminating signal pulse generated at the end of compression stroke of the #1 cylinder immediately following a CYL signal pulse. The ECU sequentially determines thereafter that the #1 cylinder is in a #1 stage, in a #2 stage, . . . and in a # 23 stage, based on CRK signal pulses generated thereafter.

Further, an injection stage of a cylinder at which injection should be started is set depending on operating conditions of the engine 1, more particularly by executing an injection stage-determining routine, not shown. Further, the valve opening period (fuel injection period TOUT) of each fuel injection valve 6 is controlled by the use of a status number (SINJ(k)) determined in relation to the injection stage.

More specifically, the status number SINJ(k) is set to "2" during the valve opening period of the fuel injection valve 6, and changed to "3" immediately upon termination of injection. The status number SINJ(k) is reset to "0" simultaneously when the explosion stroke starts, to set the fuel injection valve 6 into a standby state for a subsequent injection. Thereafter, when the cylinder reaches the predetermined injection stage (e.g. the #13 stage), the status number SINJ(k) is set to "1", and after a predetermined injection delay time period elapses, the status number SINJ(k) is again set to "2" to start fuel injection again. Immediately upon termination of the fuel injection, the status number SINJ(k) is again set to "3", and upon start of the explosion stroke, it is again reset to "0".

Figure 13:
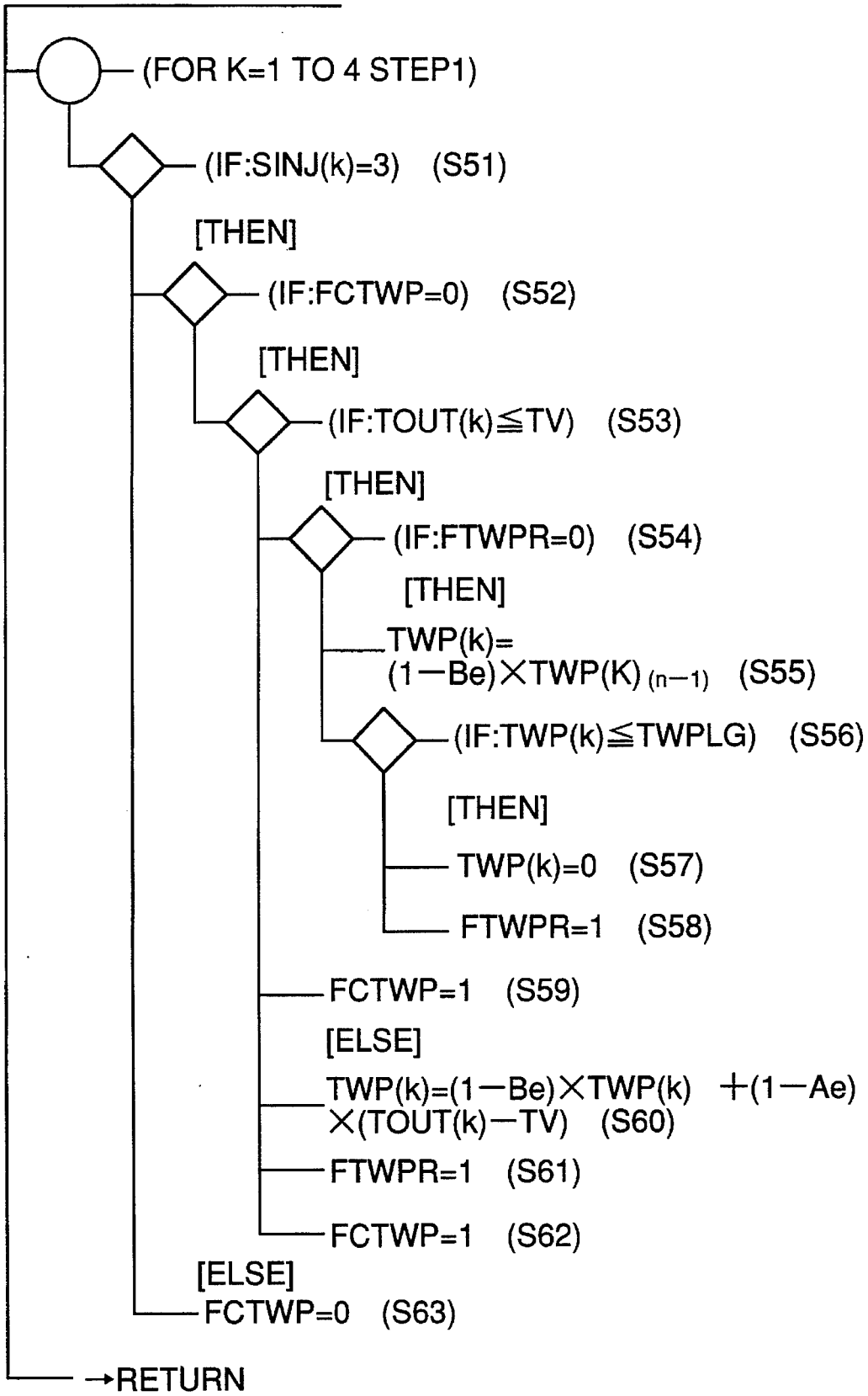
FIG. 13 is a flowchart showing a program for determining an adherent fuel amount TWP.

In the present embodiment, as will be described hereinafter with reference to FIG. 13, an amount (TWP) of fuel adhering to the inner wall surface of the intake pipe 2 is calculated when SINJ(k)=3, and then the fuel injection period TOUT is calculated, with the adherent fuel amount TWP taken into account. The injection delay time period (corresponding to the time period over which the status number SINJ(k) is equal to "1") is provided because the fuel injection timing is controlled such that the termination timing of the fuel injection is basically synchronous to generation of a CRK signal pulse. Such delay of fuel injection timing enables the fuel injection to be completed at desired injection termination timing.

The above manner of the adherent fuel-dependent correction will be described in detail with reference to programs, which are expressed in a program notation defined according to JIS X 0128, i.e. SPD (Structured Programming Diagrams).

Figure 3:
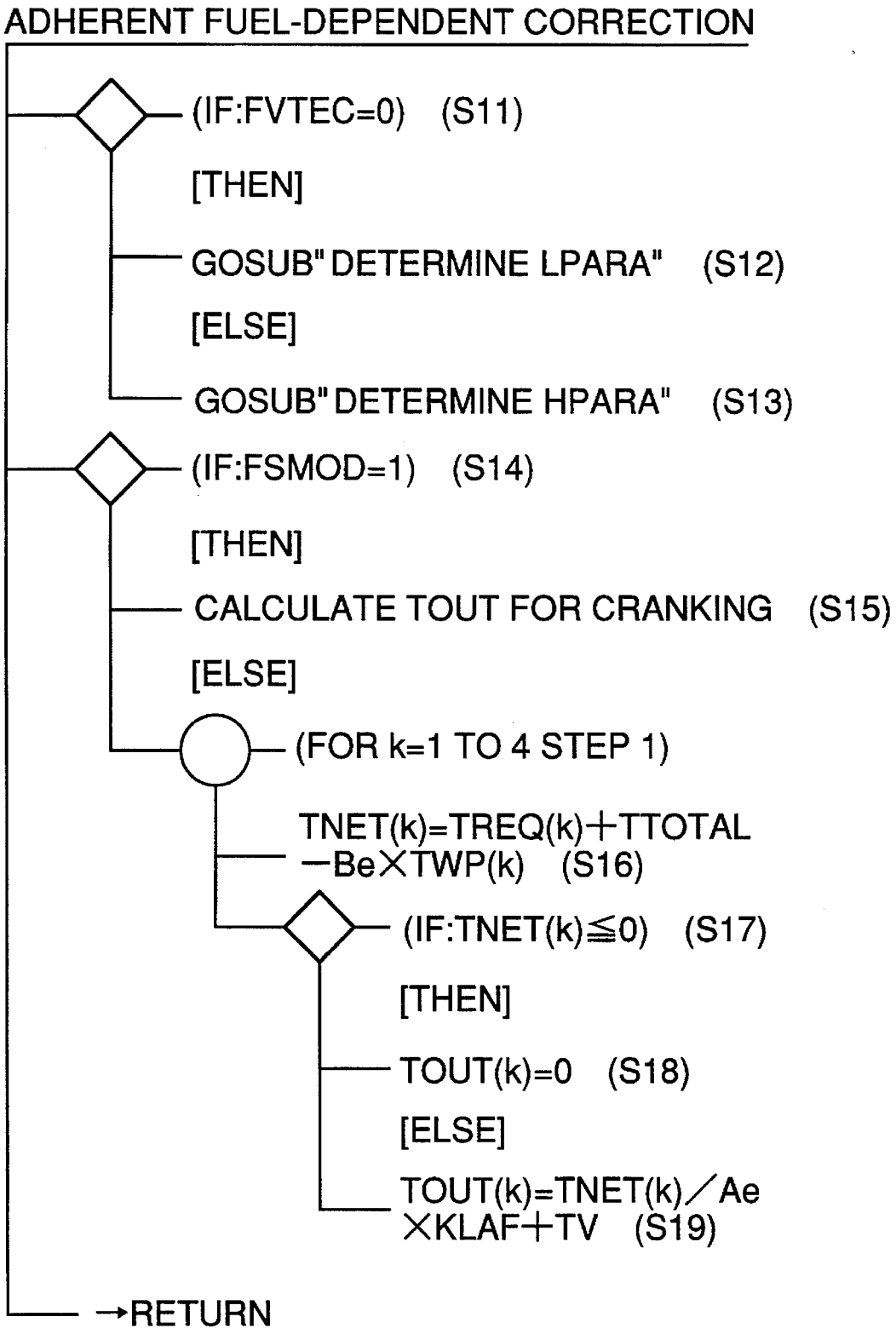
FIG. 3 is a flowchart showing a program for carrying out adherent fuel-dependent correction.

FIG. 3 shows a routine for carrying out the adherent fuel-dependent correction, which is executed in synchronism with generation of each TDC-discriminating signal pulse.

First, at a step S11, it is determined whether or not a flag FVTEC is equal to "0", i.e. whether or not the valve timing is set to the low speed V/T. If FVTEC=0, i.e. if it is determined that the valve timing is set to the low speed V/T, an LPARA-determining routine as shown in FIG. 4 is carried out at a step S12, thereby determining a fuel injection timing θINJ as well as adherent fuel-determining parameters indicative of fuel transfer characteristics suitable for the low speed V/T, i.e. a final direct supply ratio Ae and a final carry-off ratio Be of gasoline as injected fuel for use in fuel injection control during the low speed V/T.

The final direct supply ratio Ae and the final carry-off ratio Be are obtained, as will be described hereinbelow, by correcting a basic value of a direct supply ratio A and a basic value of a carry-off ratio B, based on respective engine speed-dependent correction coefficients KA, KB, and respective EGR-dependent correction coefficients KEA, KEB. The direct supply ratio A is defined as a ratio of an amount of fuel injected and directly drawn into the combustion chamber during the present operating cycle of the engine to the whole amount of fuel injected from the fuel injection valve 6 during the present operating cycle, while the carry-off ratio B is defined as a ratio of an amount of fuel carried off from fuel (gasoline) adhering to the inner wall surface of the intake pipe 2 and drawn into the combustion chamber during the present operating cycle, to the whole amount of the fuel adhering to the inner wall surface of the intake pipe 2 up to the last operating cycle.

Figure 4:
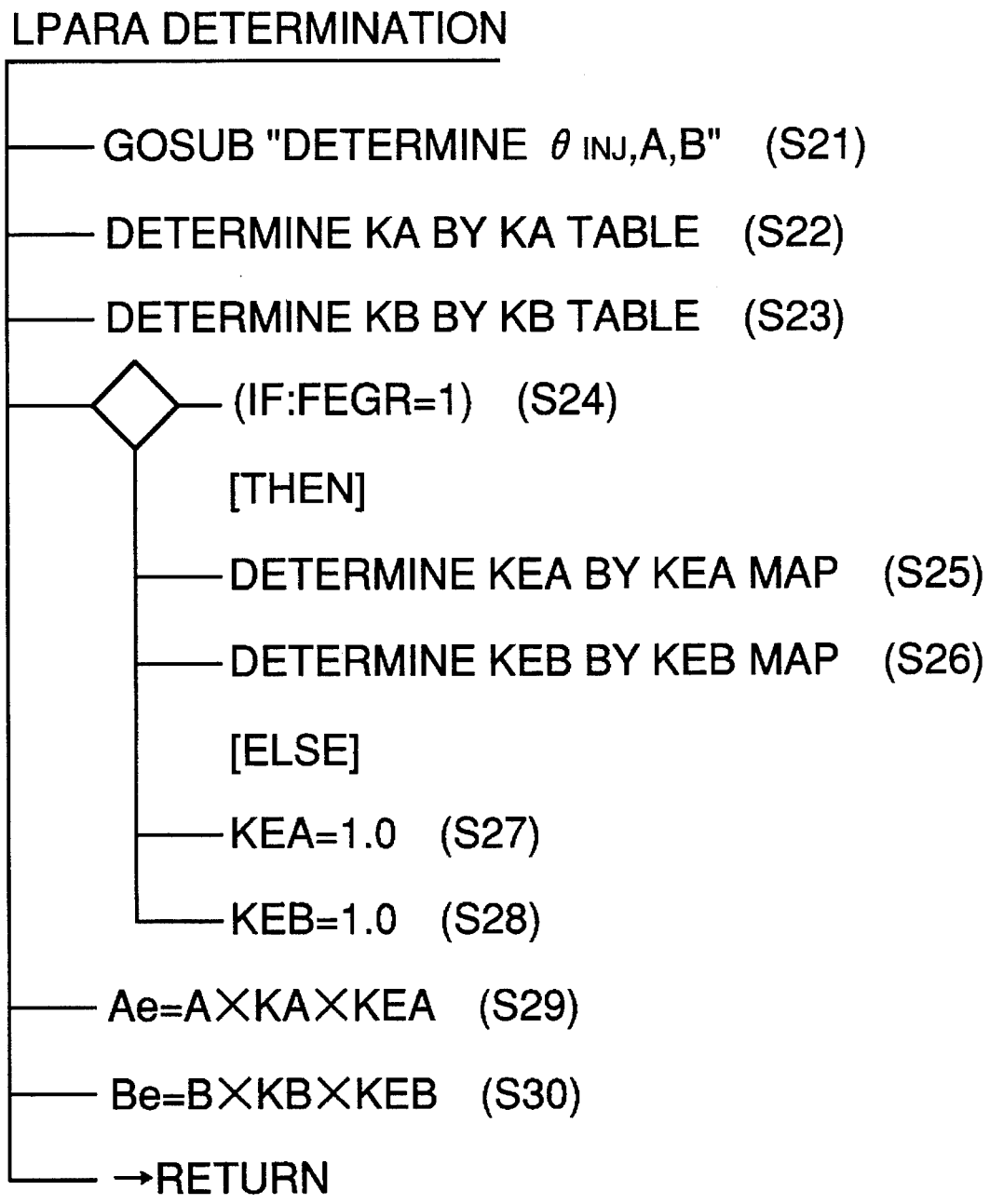
FIG. 4 is a flowchart showing a program for determining an LPARA value.

FIG. 4 shows details of the LPARA-determining routine for determining the above-mentioned adherent fuel-determining parameters, which is executed in synchronism with generation of each TDC-discriminating signal pulse.

First, at a step S21, a fuel injection timing-determining routine is carried out to determine the fuel injection timing (in the present embodiment, the fuel injection termination timing) θINJ, as well as the basic value of the direct supply ratio A and the basic value of the carry-off ratio B.

FIG. 5 shows a program for determining the fuel injection timing, which is executed in synchronism with generation of each TDC signal pulse.

First, at a step S41, the optimum fuel injection termination timing θINJA is determined by retrieving a θINJ map depending operation conditions of the engine. The θ INJ map is set, e.g. as shown in FIG. 6, such that map values θINJA (0, 0) to θINJA (6, 6) of the optimum fuel injection termination timing are provided correspondingly to predetermined values PBA0 to PBA6 of the intake pipe absolute pressure PBA and predetermined values TW0 to TW6 of the engine coolant temperature TW.

Now, a manner of setting values of θINJA (0, 0) to θINJA (6, 6) of the optimum fuel injection termination timing θINJA will be described with reference to FIG. 7A.

Figure 7A:
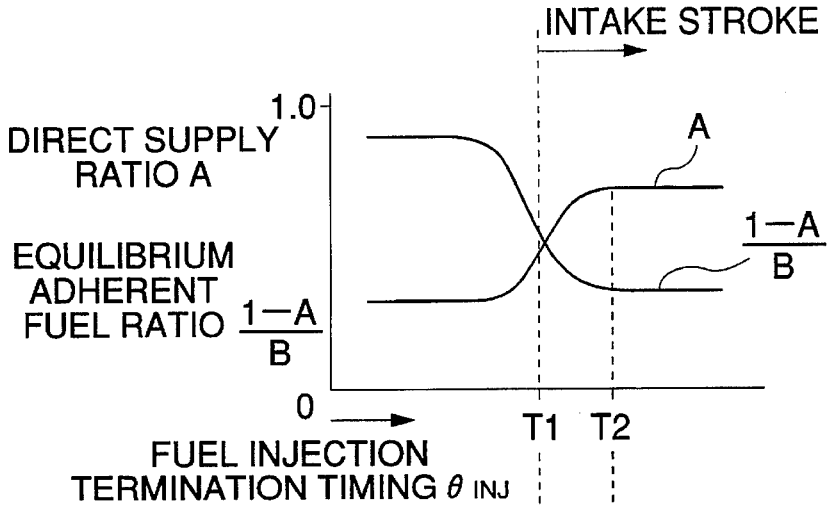
FIG. 7A is a diagram which is useful in explaining a method of setting the optimum fuel injection terminating point θINJA.

First, if the fuel injection termination timing θINJ is varied with the intake pipe absolute pressure PBA and the engine coolant temperature TW being held constant, the direct supply ratio A tends to assume, as shown in FIG. 7A, a low value before a time point T1 of the start of the intake stroke, and rise drastically after the time point T1, reaching the maximum value at a time T2. Thereafter, the direct supply ratio A tends to assume a stable or constant value. In the present embodiment, the time point T2 at which the maximum value of the basic direct supply ratio A is reached is set to the optimum time point of the fuel injection termination timing, i.e. the optimum fuel injection termination timing θINJA. It should be noted that the optimum fuel injection termination timing θINJA modifies the fuel injection termination timing controlled by the aforementioned status number SINJ(k) (particularly the fuel injection delay SINJ(k)=1).

In the present embodiment, by this manner of setting the optimum fuel injection termination timing θINJA, experimental values θINJA (0, 0) to θINJA (6, 6) are determined depending on the PBA and TW conditions set by predetermined values PBA0 to PBA6 of the intake pipe absolute pressure PBA and predetermined values TW0 to TW6 of the engine coolant temperature TW, and registered or set into the θINJ map.

Figure 8:
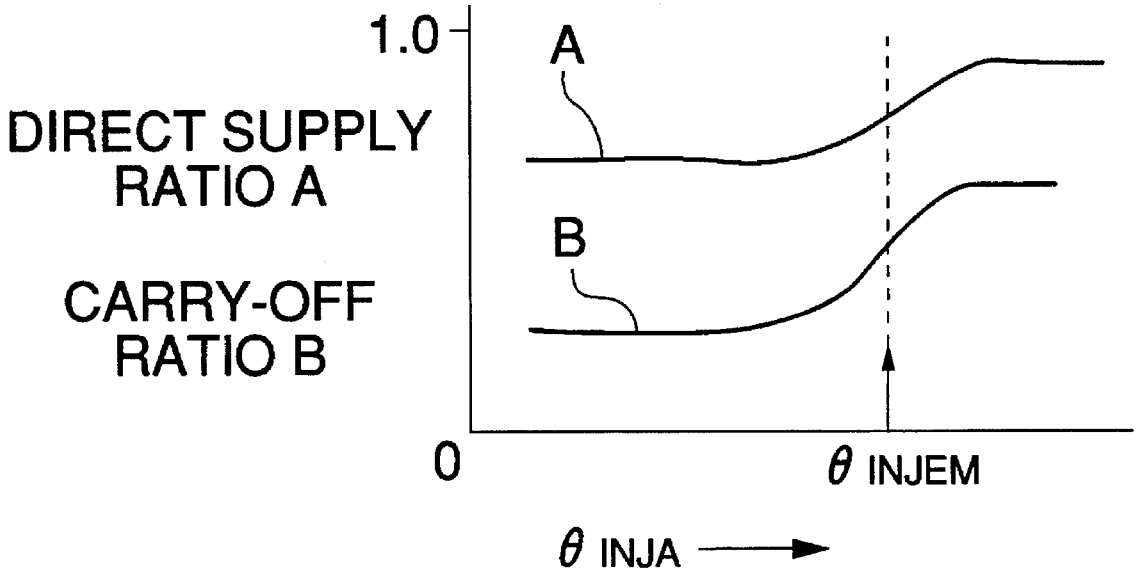
FIG. 8 shows a A/B table.

At the following step S42, a basic value of the direct supply ratio A and a basic value of the carry-off ratio B are calculated by an A/B table. More specifically, in the A/B table, there are set basic values of the direct supply ratio A and basic values of the carry-off ratio B assumed when the fuel injection termination timing is set to the optimum timing θINJA, as shown in FIG. 8. That is, these basic values of the direct supply ratio A and the carry-off ratio B are values assumed at the optimum fuel injection termination timing d INJA (T2 appearing in FIG. 2) which is set depending on the intake pipe absolute pressure PBA and the engine coolant temperature TW as described above.

Further, at the step S43, an upper limit value of the fuel injection termination timing θINJ is set to a value θINJEM, as shown in FIG. 8. Accordingly, when a value of the optimum fuel injection termination timing θINJA calculated at the step S41 exceeds the upper limit value θINJEM, the former is replaced by the latter. This is because the fuel injection termination timing set to a time point exceeding the upper limit value θINJEM is unfavorable from the viewpoint of exhaust emission characteristics of the engine.

Thus, at the following step S44, there are determined the optimum fuel injection termination timing θINJA as well as the basic value of the direct supply ratio A and the basic value of the carry-off ratio B depending on operating conditions of the engine (the intake pipe absolute pressure PBA and the engine coolant temperature TW).

Figure 7B:
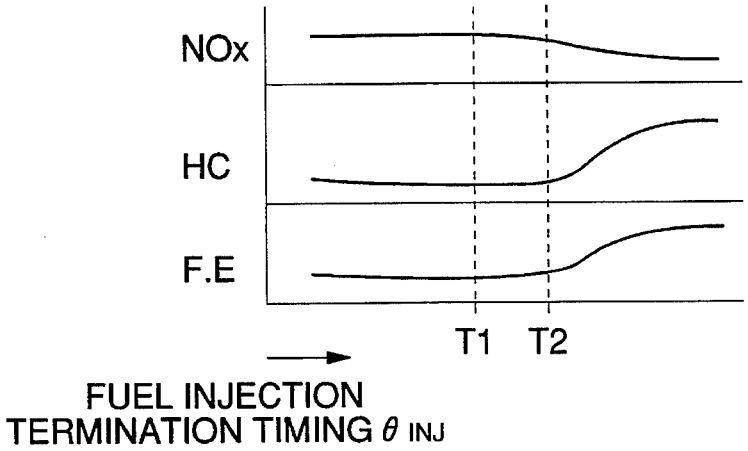
FIG. 7B is a diagram which is useful in explaining results obtained by the FIG. 7A method.

At the time point T2 appearing in FIG. 7 at which the basic value of the direct supply ratio A reaches its maximum, the ratio of fuel injected and directly drawn into the combustion chamber to the whole amount of fuel injected becomes the highest. Accordingly, the amount of fuel attached to the wall surface of the intake pipe 2 becomes the minimum. Therefore, by thus setting the fuel injection termination timing to the optimum time point, it is possible to reduce the amount of adherent fuel-dependent correction to the minimum, which in turn makes it possible to obtain the most excellent operating characteristics of the engine in respect of emission of NOx and HC, and minimize the fuel consumption, i.e. optimize the fuel economy (F.E.), as shown in FIG. 7B. In particular, when the engine is in a transient operating condition, an amount of fuel required for the transient operating condition is sufficiently and properly supplied to the combustion chamber, which makes it possible to perform fuel supply control with excellent responsiveness, thereby improving the converging behavior of the air-fuel ratio control, with excellent exhaust emission characteristics.

Instead of setting the fuel injection termination timing to the time point at which the maximum basic value of the direct supply ratio A is reached, the fuel injection termination timing may be set to a time point at which an equilibrium adherent fuel ratio reaches the minimum value, as shown in FIG. 7A. The equilibrium adherent fuel ratio is defined as a factor indicative of an amount of fuel constantly adhering to the inner wall surface of the intake pipe 2, under a steady engine operating condition of the engine in which the direct supply ratio A and the carry-off ratio B assume respective fixed values. The time point at which the equilibrium adherent fuel ratio becomes the minimum is a time point where the amount of fuel adhering to the inner wall surface of the intake pipe 2 is the minimum. By setting of the fuel injection termination timing to this time point, it is possible to obtain effects equivalent to ones obtained when the fuel injection termination timing is set to the time point at which the basic value of the direct supply ratio A becomes the maximum.

Referring again to FIG. 4, at a step S22, a KA table is retrieved to determine the engine speed-dependent correction coefficient KA for the final direct supply Ae.

Figure 9:
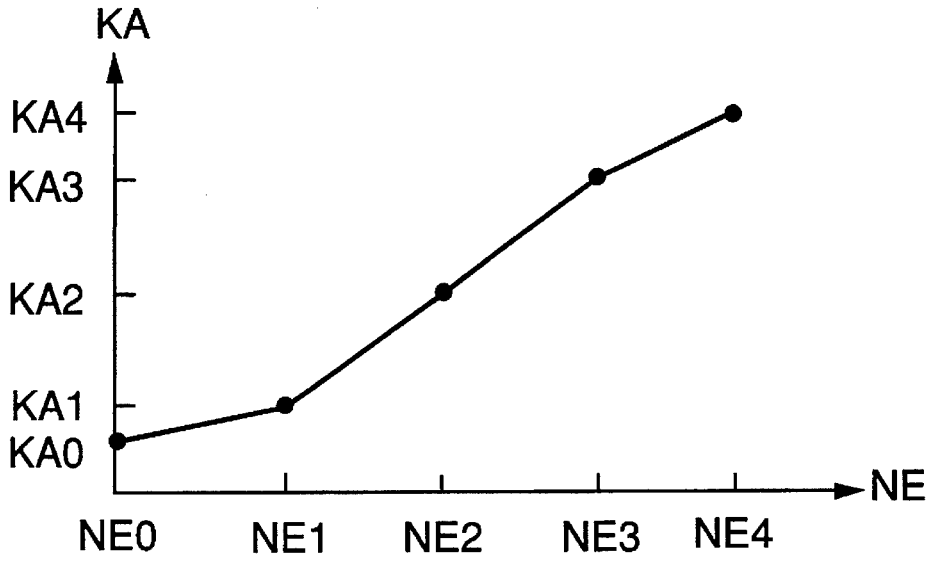
FIG. 9 shows a KA table.

The KA table is set, e.g. as shown in FIG. 9, such that table values KA0 to KA4 are provided in a manner corresponding to predetermined values NE0 to NE4 of the engine rotational speed NE. The engine speed-dependent correction coefficient KA is determined by being read from the KA table, and additionally by interpolation, if required.

Then, at a step S23, the engine speed-dependent correction coefficient KB for the final carry-off ratio Be is determined by retrieving a KB table.

Figure 10:
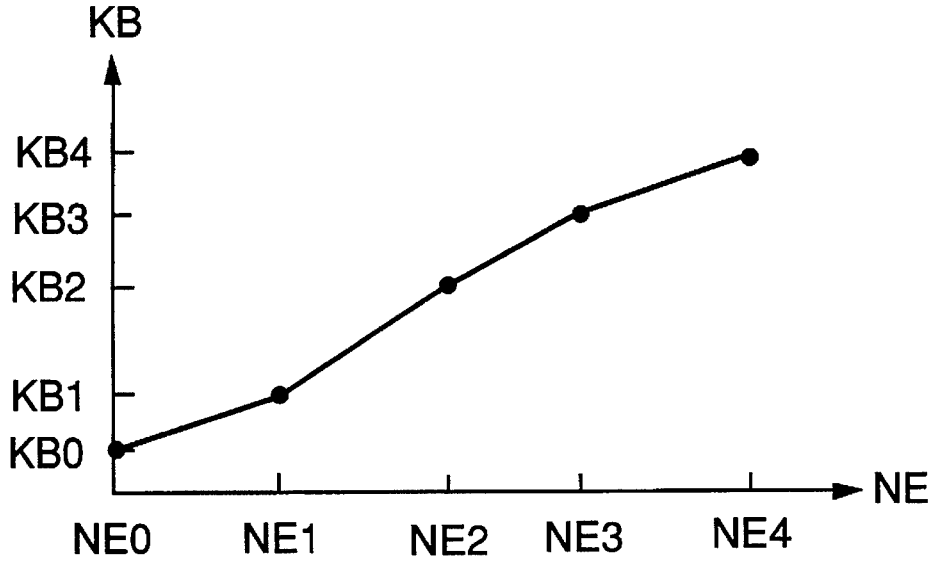
FIG. 10 shows a KB table.

The KB table is set similarly to the KA table, e.g. as shown in FIG. 10, such that table values KB0 to KB4 are provided in a manner corresponding to the predetermined values NE0 to NE4 of the engine rotational speed NE. The engine speed-dependent correction coefficient KB is determined by being read from the KB table, and additionally by interpolation, if required.

Then, at a step S24, it is determined whether or not a flag FEGR is equal to "1", i.e. whether or not the engine is in an EGR-effecting region. Whether the engine is in the EGR-effecting region is determined by determining whether the engine coolant temperature TW is above a predetermined value to be assumed when the engine has been warmed up, more specifically, by executing an EGR-effecting region-determining routine. If FEGR=1, i.e. if the engine is determined to be in the EGR-effecting region, the program proceeds to a step S25, where the EGR-dependent correction coefficient KEA for the final direct supply ratio Ae is determined by retrieving a KEA map.

The KEA map is set, e.g. as shown in FIG. 11, such that map values KEA(0,0) to KEA(6,4) are provided in a manner corresponding to predetermined values PBA0 to PBA6 of the intake pipe absolute pressure PBA and predetermined values KEGR0 to KEGR4 of the EGR-dependent correction coefficient KEGR. The EGR-dependent correction coefficient KEA is determined by retrieving the KEA map, and additionally by interpolation, if required.

Then, at a step S26, the EGR-dependent correction coefficient KEB for the final carry-off ratio Be is determined by retrieving a KEB map.

The KEB map is set, e.g. as shown in FIG. 12, such that map values KEB(0,0) to KEB(6,4) are provided in a manner corresponding to predetermined values PBA0 to PBA6 of the intake pipe absolute pressure PBA and predetermined values KEGR0 to KEGR4 of the EGR-dependent correction coefficient KEGR. The EGR-dependent correction coefficient KEB is determined by retrieving the KEB map, and additionally by interpolation, if required.

If FEGR=0, i.e. if it is determined that the engine is not in the EGR-effecting region, the EGR-dependent correction coefficients KEA, KEB are both set to "1.0" at steps S27 and S28, respectively.

Then, at steps S29 and S30, the final direct supply ratio Ae and the final carry-off ratio Be are calculated by the use of the following equations (1) and (2), respectively, followed by the program returning to the FIG. 3 main routine:

$$Ae=A\times KA\times KEA \quad (1)$$

$$Be=B\times KB\times KEB \quad (2)$$

Then, if it is determined at the step S11 of FIG. 3 that the flag FVTEC is equal to "1", the program proceeds to a step S13, wherein an HPARA-determining routine, not shown, is executed to determine adherent fuel-determining parameters suitable for the high speed V/T, i.e. a final direct supply ratio Ae and a final carry-off ratio Be of injected fuel for use in fuel injection control during the high speed V/T in a similar manner to the LPARA-determining routine.

Then, the program proceeds to a step S14, wherein it is determined whether or not a flag FSMOD is equal to "1". If FSMOD=1, it is judged that the engine is in starting mode, and then the program proceeds to a step S15, wherein a final fuel injection period TOUT suitable for the starting mode is calculated by the use of the following equation (3):

$$TOUT=TiCR\times K1+K2 \quad (3)$$

where TiCR represents a basic fuel injection period suitable for the starting mode, which is determined according to the engine rotational speed NE and the intake pipe absolute pressure PBA. A TiCR map, not shown, is used for determining the TiCR value.

K1 and K2 represent other correction coefficients and correction variables, respectively, which are set depending on operating conditions of the engine to such values as optimize operating characteristics of the engine, such as the fuel consumption and the accelerability.

On the other hand, if the flag FSMOD is equal to "0", i.e. if the engine is in basic operating mode, steps S16 et seq. are executed for each of the cylinders (#1CYL to #4CYL).

More specifically, first, at the step S16, with respect to the #1 cylinder, a desired fuel injection period TNET(k) is calculated by the use of the following equation (4):

$$TNET(k)=TREQ(k)+TTOTAL-Be\times TWP(k) \quad (4)$$

where TREQ(k) represents a required fuel injection period which corresponds to a fuel amount required to be supplied to the combustion chamber. The required fuel injection period TREQ(k) is determined by the following equation (4'):

$$TREQ(k)=TiM\times KTOTAL \quad (4')$$

where TiM represents a basic fuel injection period suitable for the basic operating mode, which is determined according to the engine rotational speed NE and the intake pipe absolute pressure PBA. A TiM map, not shown, is used for determining the TiM value. KTOTAL represents the sum of all correction coefficients which are determined based on engine operating parameter signals from various sensors.

Referring again to the equation (4), TTOTAL represents the sum of all addend correction variables (e.g. atmospheric pressure-dependent correction variable TPA) which are determined based on engine operating parameter signals from various sensors. However, a correction term TV for a so-called ineffective time period elapsed before the fuel injection valve 6 opens is not included in the TTOTAL value.

TWP(k) represents an estimated amount of fuel adhering to the inner wall surface of the intake pipe 2, which is calculated according to a routine described hereinafter with reference to FIG. 13, and hence the term (Be×TWP(k)) represents a fuel amount carried off the adherent fuel into the combustion chamber. This carried-off amount from the adherent fuel need not be newly supplied by injection, and hence is subtracted from the required fuel amount TREQ(k) according to the equation (4).

At a step S17, it is determined whether or not the desired fuel injection period TNET(k) calculated as above is equal to or smaller than "0". If TNET<"0", a final fuel injection period TOUT(k) is set to "0" to forcibly interrupt the fuel supply at a step S18, followed by terminating the program.

If TNET(k)>0, the program proceeds to a step S19, wherein the final fuel injection period TOUT is calculated by the use of the following equation (5):

$$TOUT(k)=TNET(k)/Ae\times KLAF+TV \quad (5)$$

where KLAF represents an air-fuel ratio correction coefficient determined based on an output from the LAF sensor 24, and TV the aforementioned correction term for the ineffective time period of the fuel injection valve 6.

By opening the fuel injection valve 6 over the final fuel injection period TOUT(k) calculated by the above equation (5), fuel is supplied to the combustion chamber in an amount corresponding to a value (TNET(k)×KLAF+Be×TWP(k)).

Thus, the fuel injection period has been calculated for the #1 cylinder, and then the steps S16 to S19 in FIG. 3 are repeatedly carried out similarly, to determine the final fuel injection period TOUT for the #2 cylinder to #4 cylinder as well.

FIG. 1–3 shows a TWP-determining routine for determining the adherent fuel amount TWP, which is executed for each cylinder whenever the crankshaft rotates through a predetermined angle (e.g. 30 degrees).

First, it is determined at a step S51 whether or not the status number SINJ(k) (see FIG. 2) is equal to "3", which indicates termination of fuel injection. If SINJ(k) is not equal to "3", the program proceeds to a step S63, wherein a calculation-permitting flag FCTWP is set to "0" to allow the calculation of the adherent fuel amount TWP to be started in the next or a subsequent loop.

On the other hand, if SINJ(k) is equal to "3", ≦ it is determined at a step S52 whether or not the flag FCTWP is equal to "0". If FCTWP is equal to "0", it is determined at a step S53 whether or not the final fuel injection period TOUT(k) is equal to or smaller than the ineffective time period TV. If TOUT(k)≦TV, which means that no fuel is to be injected, such as during a fuel cut state of the engine, it is determined at a step S54 whether or not a flag FTWPR is equal to "0", i.e. whether or not the adherent fuel amount TWP is negligible or zero. If the flag FTWPR is set to "0" and hence the adherent fuel amount TWP is not negligible or zero, the program proceeds to a step S55, wherein the adherent fuel amount TWP(k) in the present loop is calculated by the use of the following equation (6):

$$TWP(k)=(1-Be)\times TWP(k)(n-1) \quad (6)$$

where TWP(k)($n$–1) represents an adherent fuel amount calculated in the immediately preceding loop.

Then, it is determined at a step S56 whether or not the adherent fuel amount TWP(k) is equal to or smaller than a predetermined very small value TWPLG. If TWP(k)≦TWPLG, it is judged that the adherent fuel amount TWP(k) is negligible or zero. Then, at a step S57, the adherent fuel amount TWP(k) is set to "0", and the flag FTWPR is set to "1" at a step S58.

Then, at a step S59, the flag FCTWP is set to "1" to indicate completion of the calculation of the adherent fuel amount TWP, followed by terminating the program.

On the other hand, if TOUT(k)>TV at the step S53, which means that fuel is to be injected, so that the program proceeds to a step S60, wherein the adherent fuel amount TWP(k) is calculated by the use of the following equation (7):

$$TWP(k)=(1-Be)\times TWP(k)(n-1)+(1-Ae)\times(TOUT(k)-TV) \quad (7)$$

where TWP(k)(n–1) represents an immediately preceding value of the adherent fuel amount TWP(k). The first term on the right side represents an amount of fuel which has not been carried off from the adherent fuel and remains on the inner wall surface of the intake pipe 2 during the present cycle, and the second term on the right side represents an amount of fuel corresponding to a portion of fuel injected in the present loop which has not been drawn into the combustion chamber and newly adhered to the inner wall surface of the intake pipe 2.

Then, the flag FTWPR is set to "1" at a step S61 to indicate that the adherent fuel amount TWP is present, and further the flag FCTWP is set to "1" at a step S62 to indicate completion of the calculation of the adherent fuel amount TWP, followed by terminating the program.

What is claimed is:

1. In a control system for an internal combustion engine having an intake passage, and at least one combustion chamber, said intake passage having an inner wall surface, the control system including:

fuel supply amount-calculating means for calculating an amount of fuel to be supplied to said engine, based on load on said engine;

adherent fuel amount/carried-off fuel amount-estimating means for estimating an amount of fuel adhering to said inner wall surface of said intake passage and an amount of fuel carried off said fuel adhering to said inner wall surface of said intake passage and drawn into said combustion chamber of said engine, based on adherent fuel-determining parameters indicative of fuel transfer characteristics of said engine;

fuel supply amount-correcting means for correcting said amount of fuel calculated by said fuel supply amount-calculating means, based on said amount of fuel adhering to said inner wall surface of said intake passage and said amount of fuel carried off said fuel adhering to said inner wall surface of said intake passage, to determine a corrected amount of fuel to be supplied to said engine; and fuel injection means for injecting said corrected amount of fuel to be supplied to said engine obtained by said fuel supply amount-correcting means into said intake passage;

the improvement comprising:

fuel injection timing control means for controlling timing of said fuel injection by said fuel injection means, based on said adherent fuel-determining parameters.

2. A control system according to claim 1, wherein said adherent fuel-determining parameters include a direct supply ratio (A) defined as a ratio of an amount of fuel injected and directly drawn into said combustion chamber during a present operating cycle of said engine to the whole amount of fuel injected during the present operating cycle, and a carry-off ratio (B) defined as a ratio of an amount of fuel carried off said fuel adhering to said inner wall surface of said intake passage and drawn into said combustion chamber during the present operating cycle, to said amount of fuel adhering to said inner wall surface of said intake passage up to an immediately operating cycle of said engine, and said adherent fuel amount/carried-off fuel amount-estimating means comprising:

adherent fuel amount-estimating means for estimating said adherent fuel amount, based on said direct supply ratio (A) and said carry-off ratio (B); and carried-off fuel amount-estimating means for estimating said carried-off fuel amount, based on said direct supply ratio (A) and said carry-off ratio (B); and said fuel injection timing control means controlling said timing of fuel injection by said fuel injection means such that said direct supply ratio (A) becomes the maximum.

3. A control system according to claim 1, wherein said adherent fuel-determining parameters include a direct supply ratio (A) defined as a ratio of an amount of fuel injected and directly drawn into said combustion chamber during a present operating cycle of said engine to the whole amount of fuel injected during the present operating cycle, and a carry-off ratio (B) defined as a ratio of an amount of fuel carried off said fuel adhering to said inner wall surface of said intake passage and drawn into said combustion chamber during the present operating cycle, to said amount of fuel adhering to said inner wall surface of said intake passage up to an immediately operating cycle of said engine, and said adherent fuel amount/carried-off fuel amount-estimating means comprising:

adherent fuel amount-estimating means for estimating said adherent fuel amount, based on said direct supply ratio (A) and said carry-off ratio (B); and carried-off fuel amount-estimating means for estimating said carried-off fuel amount, based on said direct supply ratio (A) and said carry-off ratio (B); and said fuel injection timing control means controlling said timing of fuel injection by said fuel injection means such that (1−B)/A becomes the minimum.

4. A control system according to claim 1, wherein said timing of fuel injection is a time point of termination of fuel injection.

5. A control system according to claim 2, wherein said timing of fuel injection is a time point of termination of fuel injection.

6. A control system according to claim 3, wherein said timing of fuel injection is a time point of termination of fuel injection.

* * * * *